US007672632B2

(12) United States Patent
Sone et al.

(10) Patent No.: US 7,672,632 B2
(45) Date of Patent: Mar. 2, 2010

(54) FIXING APPARATUS USING INDUCTION HEATING SYSTEM FOR IMAGE FORMING APPARATUS

(75) Inventors: Toshihiro Sone, Yokohama (JP); Osamu Takagi, Chofu (JP); Satoshi Kinouchi, Shinjuku-ku (JP); Yoshinori Tsueda, Fuji (JP); Tetsuo Kitamura, Mishima (JP); Hiroshi Nakayama, Mishima (JP); Yohei Doi, Mishima (JP); Kazuhiko Kikuchi, Yokohama (JP); Masanori Takai, Izunokuni (JP); Toyoyasu Kusaka, Izu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 162 days.

(21) Appl. No.: 11/942,083

(22) Filed: Nov. 19, 2007

(65) Prior Publication Data

US 2008/0124109 A1 May 29, 2008

Related U.S. Application Data

(60) Provisional application No. 60/866,668, filed on Nov. 21, 2006, provisional application No. 60/866,685, filed on Nov. 21, 2006.

(51) Int. Cl.
*G03G 15/20* (2006.01)

(52) U.S. Cl. ..... 399/329; 399/328; 430/124.3

(58) Field of Classification Search ..... 399/329, 399/328, 333, 109, 110; 219/216; 347/156; 430/124.3

See application file for complete search history.

(56) References Cited

U.S. PATENT DOCUMENTS

| | | | | |
|---|---|---|---|---|
| 6,014,539 | A * | 1/2000 | Sano et al. | 399/329 |
| 6,898,409 | B2 | 5/2005 | Tsueda et al. | |
| 7,043,185 | B2 * | 5/2006 | Yoshikawa | 399/329 |
| 7,236,733 | B2 | 6/2007 | Tsueda et al. | |
| 7,257,361 | B2 | 8/2007 | Takagi et al. | |
| 2006/0159495 | A1 | 7/2006 | Kikuchi | |
| 2006/0204295 | A1 | 9/2006 | Takagi et al. | |
| 2006/0210294 | A1 | 9/2006 | Sone et al. | |
| 2006/0210329 | A1 | 9/2006 | Tsueda et al. | |
| 2007/0098467 | A1 | 5/2007 | Kikuchi et al. | |
| 2007/0246457 | A1 | 10/2007 | Tsueda et al. | |
| 2007/0248388 | A1 | 10/2007 | Tsueda et al. | |

(Continued)

FOREIGN PATENT DOCUMENTS

| | | |
|---|---|---|
| JP | 2002-295452 | 10/2002 |

(Continued)

OTHER PUBLICATIONS

Machine translation of JP 2005-250298 A dated 6/23/09.*

*Primary Examiner*—Sophia S Chen
(74) *Attorney, Agent, or Firm*—Turocy & Watson, LLP

(57) ABSTRACT

A heat roller of a fixing apparatus according to an embodiment of the invention has a slidable metal belt on an outer side of an elastic roller. The width of the metal belt is made larger than that of the elastic roller. Flanges, each of which regulates a sliding movement of the metal belt by being in contact with an edge of the metal belt, are provided on both sides of a press roller opposite the metal belt.

13 Claims, 6 Drawing Sheets

U.S. PATENT DOCUMENTS

2007/0258740 A1 11/2007 Tsueda et al.
2007/0274734 A1 11/2007 Kikuchi
2008/0118282 A1 5/2008 Takagi et al.
2008/0118283 A1 5/2008 Tsueda et al.
2008/0260406 A1 10/2008 Sone et al.
2008/0260437 A1 10/2008 Takagi et al.

FOREIGN PATENT DOCUMENTS

JP 2005-250298 9/2005

* cited by examiner

FIXING APPARATUS USING INDUCTION HEATING SYSTEM FOR IMAGE FORMING APPARATUS

CROSS REFERENCE TO RELATED APPLICATION

This invention is based upon and claims the benefit of priority from prior U.S. patent applications Ser. No. 60/866,668 and 60/866,685 filed on Nov. 21, 2006, the entire contents of which are incorporated herein by reference.

BACKGROUND OF THE INVENTION

1. Field of the Invention

The present invention relates to a fixing apparatus provided in an image forming apparatus, such as a copying machine, a printer, and a facsimile, and a roller used in the fixing apparatus, and in particular, a fixing apparatus of an image forming apparatus using an induction heating method and a control method of the fixing apparatus.

2. Description of the Background

There is a fixing apparatus that is used in an image forming apparatus, such as an electro photographic copying machine or printer, and adopts an induction heating method. As such an induction heating and fixing apparatus, for example, a heat roller having a metal belt around an elastic layer is disclosed in JP-A-2002-295452.

However, in such a known apparatus described above, a case in which the metal belt may slide on the elastic layer and be replaced is not mentioned.

Therefore, in a case in which a metal belt having a metal layer can be made to slide on an elastic roller, it is preferable to develop a fixing apparatus of an image forming apparatus capable of increasing the life of the metal belt and the elastic roller by preventing the metal belt or the elastic layer from being broken at an early stage due to the sliding movement.

SUMMARY OF THE INVENTION

It is an aspect of the invention to provide a highly reliable fixing apparatus of an image forming apparatus capable of increasing the life of an elastic layer and a metal belt by preventing the elastic layer and the metal belt from being damaged even in a case in which the metal belt makes a sliding movement with respect to the elastic roller in the longitudinal direction of the elastic roller.

According to an embodiment of the present invention, a fixing apparatus of an image forming apparatus includes: a metal belt having a metal layer; an elastic roller which is disposed on an inner side of the metal belt to slidably support the metal belt, whose width is shorter than the width of the metal belt, and which has an elastic layer on a surface thereof; an opposite member that is opposite to the elastic roller with the metal belt interposed there between and nips the metal belt together with the elastic roller; and an induction current generator that performs induction heating on the metal layer.

DETAILED DESCRIPTION OF THE INVENTION

Figure 1:
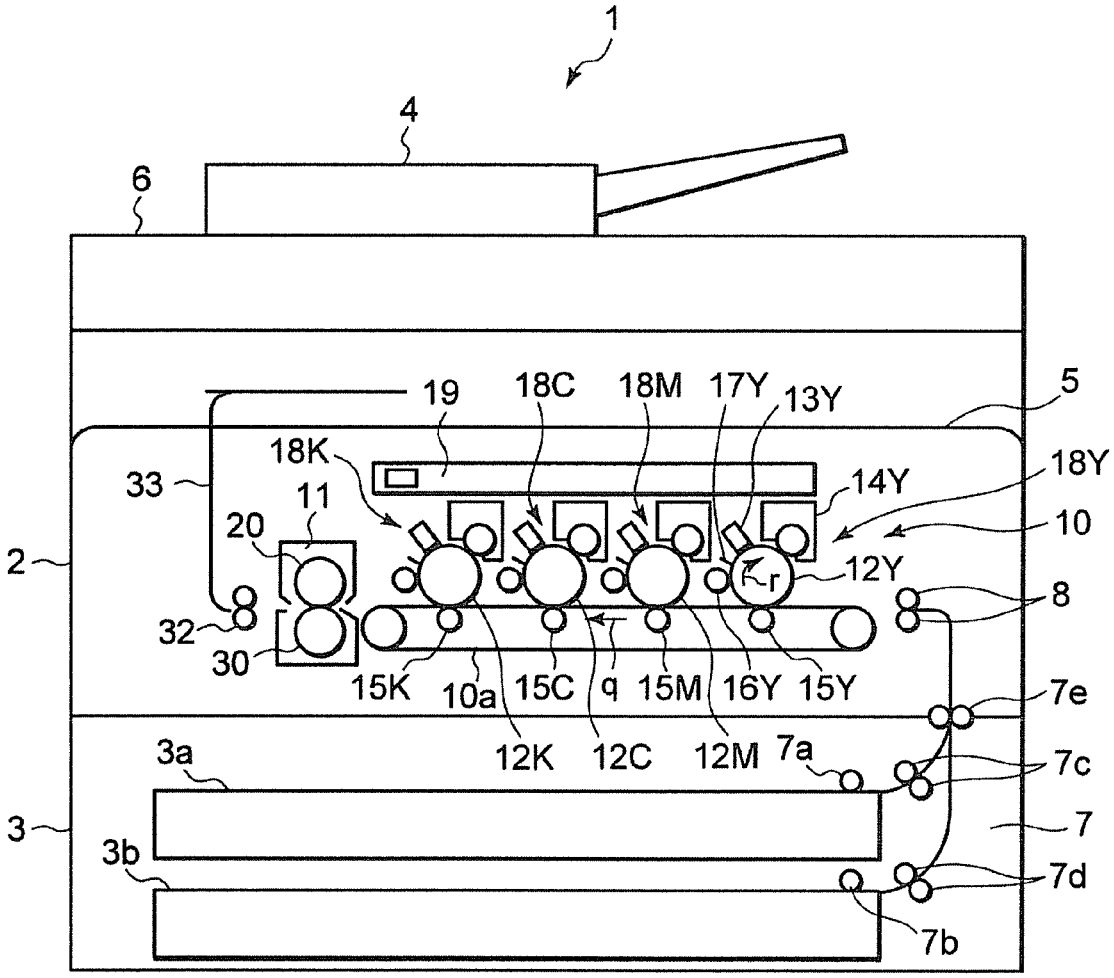
FIG. 1 is a view schematically illustrating the configuration an image forming apparatus according to a first embodiment of the invention.

Hereinafter, a first embodiment of the invention will be described in detail using the accompanying drawings as an example. FIG. 1 is a view schematically illustrating the configuration an image forming apparatus 1 according to the first embodiment of the invention. The image forming apparatus 1 includes a scanner unit 6 that reads an original document and a paper feed unit 3 that feeds sheet paper P, which is a recording medium, to a printer unit 2 that forms an image. The scanner unit 6 converts image information, which is read from the original document fed by an automatic document feed unit 4 provided on an upper surface of the scanner unit 6, into an analog signal.

The printer unit 2 includes an image forming unit 10 in which image forming stations 18Y, 18M, 18C, and 18K corresponding to colors of yellow (Y), magenta (M), cyan (C), and black (K) are arranged in tandem along a transfer belt 10*a* rotating in the direction of arrow q. In addition, the image forming unit 10 includes a laser exposure device 19 that irradiates laser beams, which correspond to image information, onto photoconductive drums 12Y, 12M, 12C, and 12K of the image forming stations 18Y, 18M, 18C, and 18K corresponding to respective colors. In addition, the printer unit 2 includes a fixing apparatus 11 and a paper discharge roller 32 and has a paper carrying path 33 along which the sheet paper P after fixing is carried to a paper discharge unit 5.

The image forming station 18Y of the image forming unit 10 corresponding to yellow (Y) includes an electric charger 13Y, a developer 14Y, a transfer roller 15Y, a cleaner 16Y, and a charge remover 17Y disposed around the photoconductive drum 12Y rotating in the direction of arrow r. The image forming stations 18M, 18C, and 18K corresponding to the colors of magenta (M), cyan (C), and black (K) are configured in the same manner as the image forming station 18Y corresponding to yellow (Y).

The paper feed unit 3 includes first and second paper feed cassettes 3*a* and 3*b*. Pickup rollers 7*a* and 7*b* that takes out the sheet paper P from the paper feed cassettes 3*a* and 3*b*, separable carrying rollers 7*c* and 7*d*, a carrying roller 7*e*, and a resist roller 8 are provided on a carrying path 7 of the sheet paper P from the paper feed cassettes 3*a* and 3*b* to the image forming unit 10.

By the start of a print operation, the photoconductive drum 12Y rotates in the direction of arrow r and are uniformly charged by the electric charger 13Y in the image forming station 18Y corresponding to yellow (Y) of the printer unit 2. Then, exposure corresponding to yellow image information read by the scanner unit 6 is performed on the photoconductive drum 12Y by the laser exposure device 19, such that an electrostatic latent image is formed. Then, toner is supplied onto the photoconductive drum 12Y by the developer 14Y, such that a yellow (Y) toner image is formed on the photoconductive drum 12Y. The yellow toner image is transferred onto the sheet paper P, which is carried in the direction of arrow q on the transfer belt 10*a*, at the position of the transfer roller 15Y. After transferring of the toner image is completed, toner remaining on the photoconductive drum 12Y is cleaned by the cleaner 16Y and electric charges on a surface of the photoconductive drum 12Y are removed by the charge remover 17Y, such that next printing becomes possible.

Also in the image forming stations 18M, 18C, and 18K corresponding to the colors of magenta (M), cyan (C), and black (K), toner images are formed in the same manner as the image forming station 18Y corresponding to yellow (Y). The toner images, which correspond to the respective colors, formed in the image forming stations 18M, 18C, and 18K are sequentially transferred onto the sheet paper P, on which the yellow toner image is formed, at the positions of the transfer rollers 15M, 15C, and 15K. On the sheet paper P a color toner image is formed as described above and fixed by heating and pressing of the fixing apparatus 11, and thus a print image is completed. Then, the sheet paper P is discharged to the paper discharge unit 5.

Figure 2:
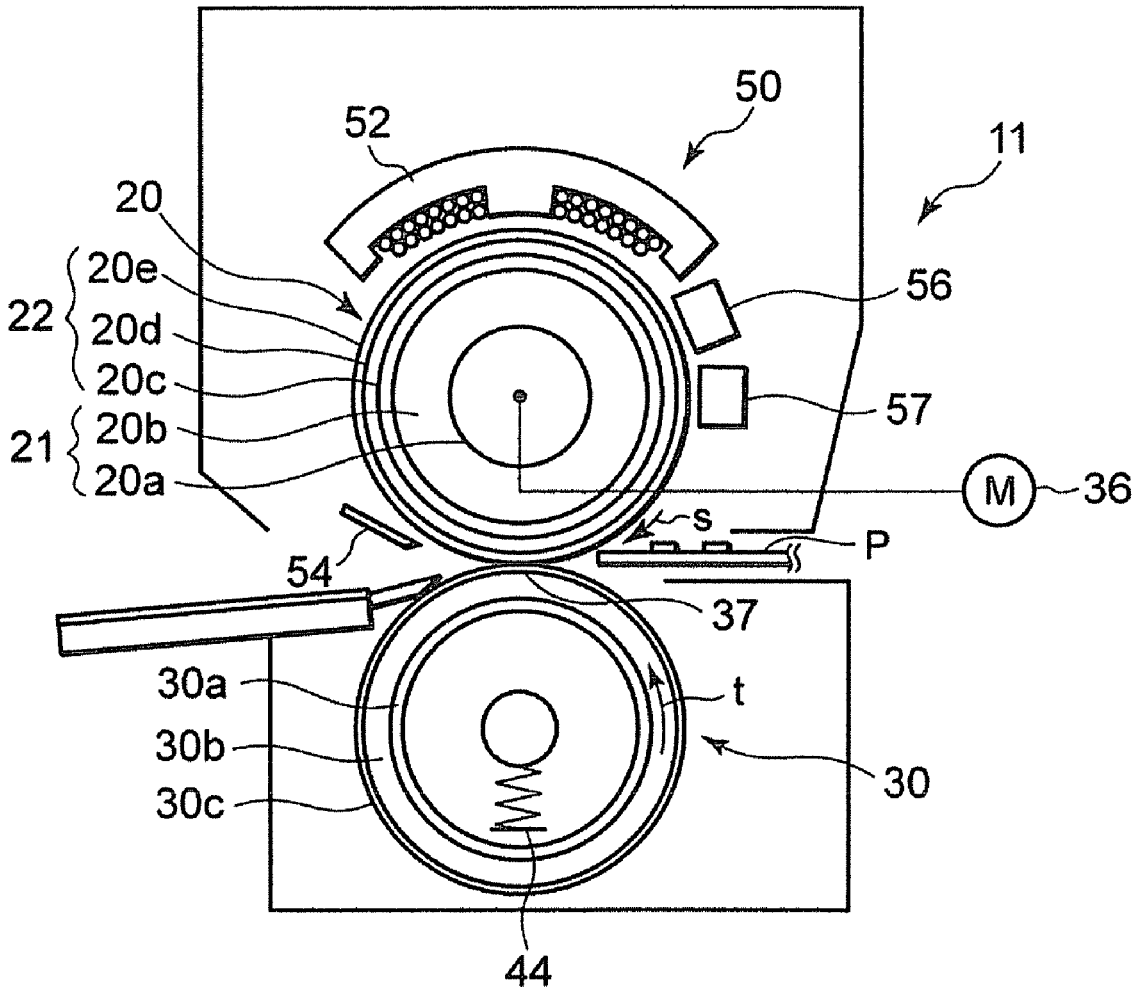
FIG. 2 is a view schematically illustrating the configuration of a fixing apparatus according to the first embodiment of the invention as viewed from an axial direction.

Next, the fixing apparatus 11 will be described. FIG. 2 is a view schematically illustrating the configuration of the fixing apparatus 11 as viewed from an axial direction. The fixing apparatus 11 has a heat roller 20 and a press roller 30 that is an opposite member. The outer diameter of each of the heat roller 20 and the press roller 30 is set to 40 mm, for example. The press roller 30 is pressed against and in contact with the heat roller 20 by means of a pressing mechanism having a spring 44. Thus, a nip 37 having a predetermined width is formed between the heat roller 20 and the press roller 30.

The heat roller 20 is driven in the direction of arrow by means of a fixing motor 36. The press roller 30 is driven by the heat roller 20 and rotates in the direction of arrow t. The heat roller 20 and the press roller 30 nip the sheet paper P with the nip 37 and carry the sheet paper P in the direction of the paper discharge roller 32. The sheet paper P passes through the nip 37 between the heat roller 20 and the press roller 30, such that a toner image on the sheet paper P is fixed by heating and pressing. However, a driving mechanism and a pressing mechanism between the heat roller 20 and the press roller 30 are not limited. For example, it may be possible to cause the heat roller 20 to be driven by driving the press roller 30 with a fixing motor or to provide a driving mechanism for both the heat roller 20 and the press roller 30. Moreover, pressure may be applied from the heat roller 20 side to the press roller 30.

The heat roller 20 has an elastic roller 21 and a metal belt 22. The elastic roller 21 has a metal shaft 20*a* formed of iron (Fe) or aluminum, for example, and a foam silicon rubber layer 20*b* that serves as an elastic layer disposed on the periphery of the metal shaft 20*a* and has a thickness of 10 mm, for example. The foam silicon rubber layer 20*b* has a heat resistance property and is formed by using open cell micro cellular foam having an average cell diameter of about 150 micron, for example. Moreover, the ASCAR-C rubber hardness of the foam silicon rubber layer 20*b* is 45° or less and the elastic modulus (Young's modulus) of the foam silicon rubber layer 20*b* is $3.5*10^{-4}$ or less.

The metal belt 22 is formed by providing a silicon rubber layer 20*d* having a thickness of 200 μm, for example, which is a rubber layer, on a surface of a metal conductive layer 20*c* that is made of a nickel (Ni), for example, and is a metal layer having a thickness of 40 μm and by further laminating a release layer 20*e* on a surface of the silicon rubber layer 20*d*. The release layer 20*e* is formed by using a fluorine resin (PFA or PTFE (polytetrafluoroethylene) or mixture of PFA and PTFE), for example. In addition, the metal layer is not limited to nickel, but stainless steel, aluminum, or mixture of stainless steel and aluminum may be used.

The metal shaft 20*a* and the foam silicon rubber layer 20*b* of the elastic roller 21 are fixed to each other. The metal conductive layer 20*c* and the silicon rubber layer 20*d* of the metal belt 22 are fixed to each other, and the silicon rubber layer 20*d* and the release layer 20*e* are fixed to each other. However, the foam silicon rubber layer 20*b* and the metal conductive layer 20*c* do not adhere to each other. Therefore, since the metal belt 22 is not adhered and fixed to the elastic roller 21, the metal belt 22 can freely slide on the elastic roller 21 in the longitudinal direction of the elastic roller. In addition, the metal belt 22 may be replaced when a life of the metal belt 22 is ended.

Figure 3:
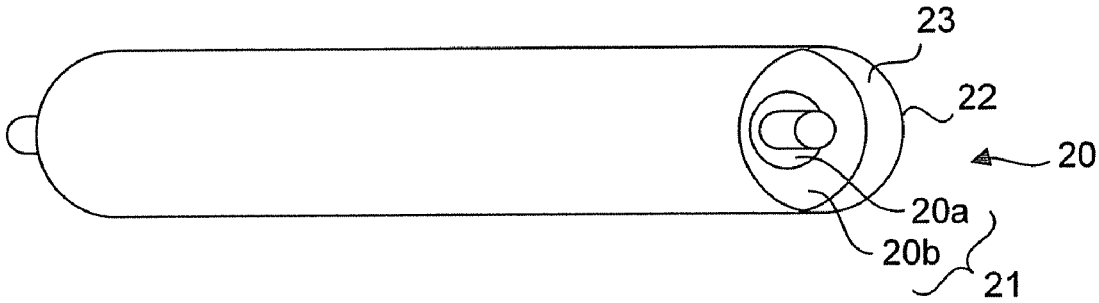
FIG. 3 is a perspective view schematically illustrating a heat roller in the first embodiment of the invention.
Figure 4:
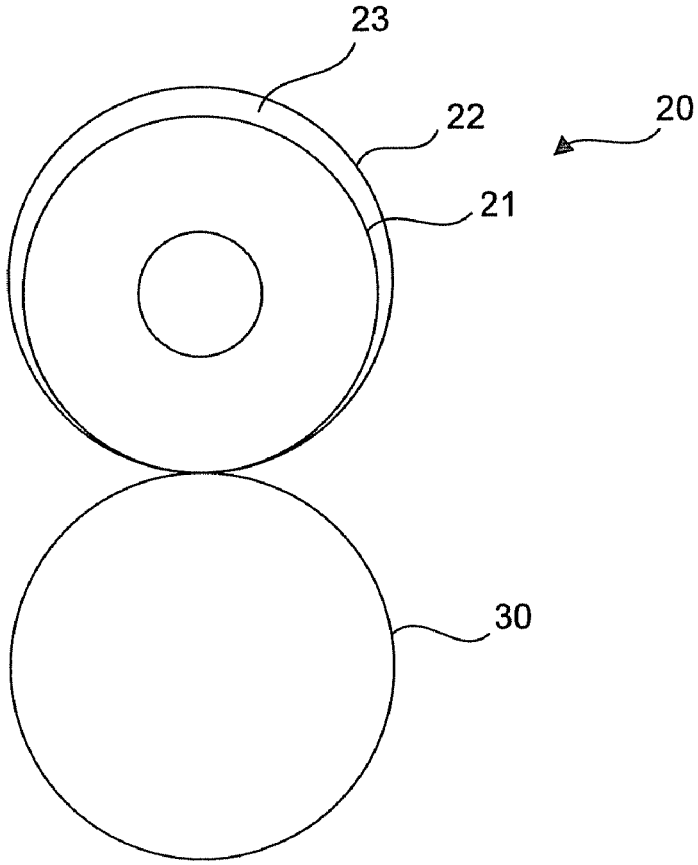
FIG. 4 is an explanatory view schematically illustrating an elastic roller, a metal belt, and a press roller at the room temperature in the first embodiment of the invention.

In addition, as shown in FIG. 3, the outer diameter of the elastic roller 21 is set to be smaller than the inner diameter of the metal belt 22, for example, by about 0.2 to 0.7 mm when the foam silicon rubber layer 20*b* is maintained at the room temperature (25° C.). Accordingly, as shown in FIG. 4, if the metal belt 22 is made to be nipped between the elastic roller 21 and the press roller 30 at the room temperature (25° C.), a space 23 is generated between the elastic roller 21 and the metal belt 22. The elastic roller 21 is thermally expanded by heating. For example, a surface of the heat roller 20 is set to have a fixable temperature of 160° C. and is in a standby mode in this state. Then, the foam silicon rubber layer 20*b* gradually expands from the vicinity of the surface in the central direction of the roller, such that the outer diameter of the elastic roller 21 becomes larger than the inner diameter of the metal belt 22 by about 0.2 to 0.5 mm, for example. Then, the metal belt 22 fits onto the elastic roller 21 in a state in which the metal belt 22 fastens the elastic roller 21.

Figure 5:
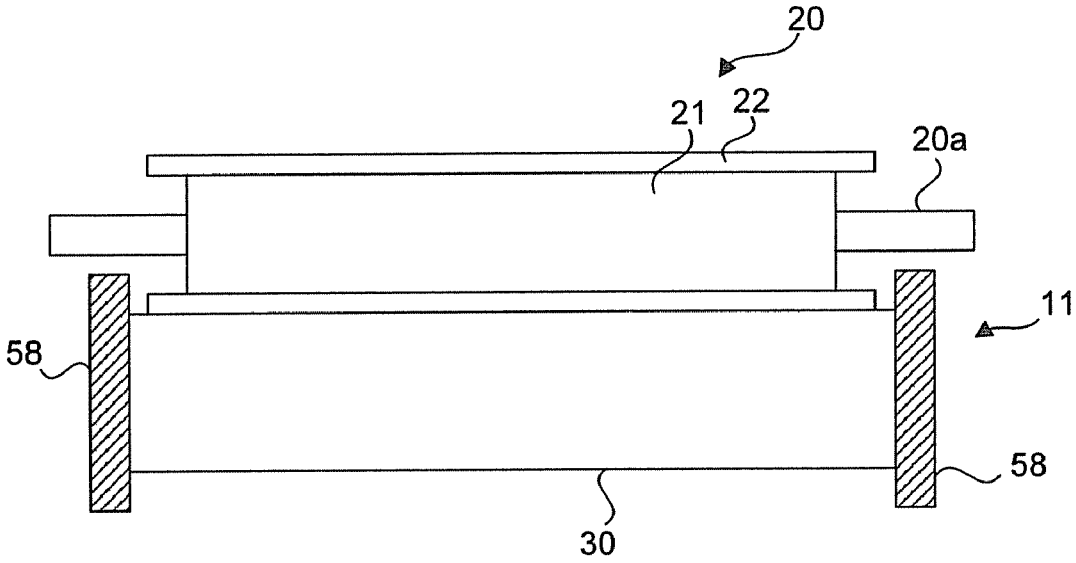
FIG. 5 is a view schematically explaining a heat roller and a press roller in the first embodiment of the invention, as viewed from a direction parallel to an axis.

The press roller 30 is formed by covering, for example, a silicon rubber layer 30*b* and a release layer 30*c* on the periphery of a hollow metal shaft 30*a*. The thickness and the like of the silicon rubber layer 30*b* of the press roller 30 are not limited. The metal shaft 30*a* and the silicon rubber layer 30*b* are fixed to each other with an adhesive or the like, and the silicon rubber layer 30*b* and the release layer 30*c* are fixed to each other with an adhesive or the like. A flange 58, which is a regulating member for regulating that the metal belt 22 slides in the axial direction of the elastic roller 21 and is formed of a synthetic resin having heat resistance or the like, is attached on both sides of the press roller 30, as shown in FIG. 5. It is preferable that an allowable temperature limit be 200° C. or more.

For example, the flange 58 fits in a concave groove, which is formed on the metal shaft 30*a*, so as to be slightly loose and is formed such that the outer diameter of the flange 58 is larger than the press roller. An inside surface of the flange 58 being in contact with the metal belt 22 is formed to be smooth. Without providing a protrusion and the like on the inside surface of the flange 58, a parting line made on the surface when forming the flange 58 made of a resin or influx of a resin material is removed. In addition, in order to further reduce friction occurring between the flange 58 and the metal belt 22, a smooth layer or a sliding layer may be provided on the inside surface of the flange 58. Even though the flange 58 can freely rotate around the metal shaft 30*a* since the flange 58 fits in a groove of the metal shaft 30*a* so as to be slightly loose, the flange 58 may be fixed to the metal shaft 30*a*. Moreover, if the flange 58 is regulated in the longitudinal direction, the flange 58 may be regulated by an E ring or a C ring, for example.

Figure 6:
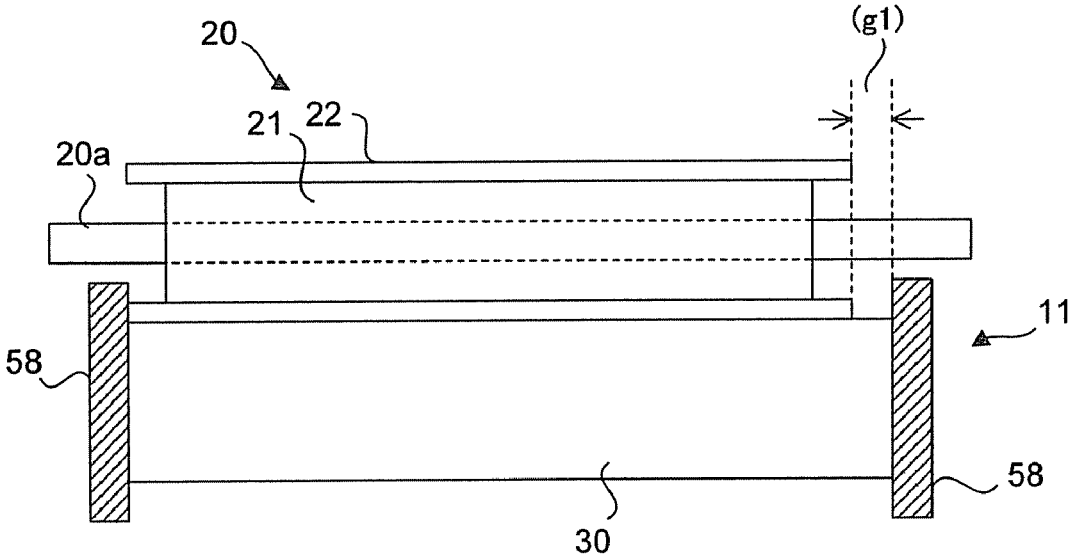
FIG. 6 is an explanatory view schematically illustrating a width between a metal belt and a flange in the first embodiment of the invention.

The width of the elastic roller 21 of the heat roller 20 is formed to be shorter than that of the metal belt 22. Accordingly, even if an end of the metal belt 22 slides up to the position being in contact with the flange 58, the end of the elastic roller 21 is not exposed. Moreover, as shown in FIG. 6, a gap g1 is provided between inside of the flanges 58, which are positioned at both sides of the press roller 30, and edges of the metal belt 22. The gap g1 is set to be 0.5 mm or more at the other free end of the metal belt 22 when an edge of an end of the metal belt 22 is made to be contact with the flange 58.

A separation claw 54 that prevents curling of the sheet paper P after fixing, an induction current generating coil 50 that is an induction current generator that performs induction heating on the metal conductive layer 20*c* of the heat roller 20, a thermopile-type infrared sensor 56 that detects the surface temperature of the heat roller 20, and a thermostat 57 that detects trouble of the surface temperature of the heat roller 20 and shut down supply of power to the induction current generating coil 50 are provided around the outer periphery of the heat roller 20. The separation claw 54 may be of a contact type or a non-contact type.

The induction current generating coil 50 is provided adjacent to the outer periphery of the heat roller 20, has a shape having approximately the same axis as the heat roller 20, and is formed by winding a wire material around a magnetic core 52 for focusing magnetic flux on the heat roller 20. For example, the Litz wire obtained by tying a plurality of copper wires, each of which is coated with heat-resistant polyamidoimide and which are insulated from each other, is used as a wire material. By using the Litz wire as a wire material, it is possible to make the diameter of the wire material smaller than the depth of penetration of a magnetic field. This allows a high-frequency current to effectively flow through the wire material.

The induction current generating coil 50 is provided on the outer periphery of the heat roller 20 so as to have a predetermined gap between the induction current generating coil 50 and the heat roller 20. Due to a magnetic field generated by supplying predetermined power to the induction current generating coil 50, an eddy current is generated in the metal layer 20*c*. The metal layer 20*c* is heated due to the eddy current.

The induction current generating coil 50 and the like are disposed on the outer periphery of the heat roller 20 in this manner, and accordingly, the outer periphery of the heat roller 20 is restricted in terms of a space. Therefore, in the same manner as in the present embodiment, it is possible to save a space around the heat roller 20 by providing the external flange 58 on both sides of the press roller 30 not on the heat roller 20. As a result, it is possible to make the entire fixing apparatus 11 small.

Next, an operation will be described. By start of warming up, driving of the fixing motor 36 is started and warming-up power is supplied to the induction current generating coil 50. The heat roller 20 is rotated in the direction of arrow s by driving of the fixing motor 36, such that the press roller 30 is driven in the direction of arrow t. Then, the metal belt 22 is nipped between the heat roller 20 and the press roller 30 to be carried in the direction of arrow s. At the start of warming up, the image forming apparatus 1 is set to have almost the room temperature (25° C.), and the layer thickness of the foam silicon rubber layer 20*b* is about 10 mm and the inner diameter of the metal belt 22 is larger than the outer diameter of the elastic roller 21. Therefore, a space 23 is provided between the metal belt 22 and the elastic rollers 21.

If the metal belt 22 is carried in such state, a zigzag movement of the metal belt 22 easily occurs in the case when pressure between the heat roller 20 and the press roller 30 in the width direction of the metal belt 22 is not constant in the longitudinal direction of a nip. Due to the zigzag movement, the metal belt 22 makes a sliding movement in the width direction of the elastic roller 21. In the case when the metal belt 22 makes the sliding movement in such manner, the further sliding movement of the metal belt 22 is regulated when the edge becomes in contact with the flange 58. Accordingly, it is prevented that the metal belt 22 is inclined from the elastic roller 21 in one direction and run off a fixing area.

In the state in which the edge of the metal belt 22 is in contact with the flange 58, the elastic roller 21 is not exposed from the edge of the metal belt 22 even at a non-regulated edge side of the metal belt 22, as shown in FIG. 6. Accordingly, there is no case in which the edge of the metal belt 22 damages the foam silicon rubber layer 20*b* due to the sliding movement of the metal belt 22. As a result, it is possible to make the life of the elastic roller 21 long and to prevent abrasion powder generated due to abrasion of the foam silicon rubber layer 20*b* from contaminating the inside of the image forming apparatus 1.

Furthermore, since the inside surface of the flange 58 is formed smooth, it is possible to reduce a load to the edge of the metal belt 22 applied due to the flange 58 even when the edge of the metal belt 22 comes in contact with the flange 58. Accordingly, since it is possible to avoid that the metal conductive layer 20*c* is damaged due to contact with the flange 58, it is possible to make a life of the metal belt 22 long.

On the other hand, due to warming up, the metal conductive layer 20*c* is inductively heated by the induction current generating coil 50 in the heat roller 20. Accordingly, the foam silicon rubber layer 20*b* of the elastic roller 21 is also heated. This thermally expands the foam silicon rubber layer 20*b*. When thermal expansion of the foam silicon rubber layer 20*b* progresses to increase the outer diameter of the elastic roller, the metal belt 22 fastens the elastic roller 21, such that the metal belt 22 fits onto the elastic roller 21.

When the surface temperature of the heat roller 20 reaches a fixable temperature, for example, 160° C. and warming-up is thus completed, the image forming apparatus 1 becomes in a standby mode (the fixable temperature is maintained, and when a print instruction is made, printing becomes possible immediately). In the standby mode, power supplied to the induction current generating coil 50 is feedback controlled in the fixing apparatus 11 such that the fixable temperature is maintained by causing the infrared sensor 56 to detect the surface temperature of the heat roller 20.

Even if the surface temperature of the heat roller 20 reaches the fixable temperature, the foam silicon rubber layer 20*b* of the elastic roller 21 does not expand rapidly, but the space 23 still remains between the elastic roller 21 and the metal belt 22 for about one hour from the start of heating. That is, the metal belt 22 does not fit onto the elastic roller 21. For this reason, while the metal belt 22 is being carried in a state in which the metal belt 22 is nipped between the heat roller 20 and the press roller 30, there is a case in which the metal belt 22 makes a sliding movement in the axial direction of the heat roller 20. However, even if the metal belt 22 makes a sliding movement, the edge of the metal belt 22 is regulated by the flange 58 in the same manner as the case of warming up, such that further sliding movement is prevented. Therefore, even if the metal belt 22 makes a sliding movement at the time of carrying after warming up is completed, the edge of the metal belt 22 does not damage the foam silicon rubber layer 20*b*, in the same manner as the warming up. Moreover, it is possible to prevent that the metal belt 22 is largely run off the elastic roller 21, and accordingly, the metal belt 22 is shifted from a fixing area. Accordingly, it is possible to make the life of the elastic roller 21 and the metal belt 22 long.

If a printing instruction is made after warming up is completed, the printer unit 2 starts a printing operation such that the image forming unit 10 forms a toner image on the sheet paper P. Subsequently, the sheet paper P having the toner image thereon is made to pass through the nip 37 between the heat roller 20 and the press roller 30, such that the toner image is fixed by heating and pressing.

In the meantime, if the heat roller 20 reaches the fixable temperature and the foam silicon rubber layer 20*b* is heated, the foam silicon rubber layer 20*b* of the elastic roller 21 is expanded up to a thickness of about 11 mm, for example. That is, the outer diameter of the elastic roller 21 becomes larger than the inner diameter of the metal belt 22 by about 0.2 to 0.5 mm. Accordingly, the metal belt 22 fits onto the elastic roller 21 in a state in which the metal belt 22 fastens the elastic roller 21. While reaching this state, the space 23 between the elastic roller 21 and the metal belt 22 is gradually decreased but the metal belt 22 can make a sliding movement in the axial direction of the heat roller 20. Even in this case, a further sliding movement of the metal belt 22 is regulated since an edge of the metal belt 22 that makes a sliding movement in the axial direction of the heat roller 20 is in contact with the flange 58.

After the metal belt 22 firmly fits onto the elastic roller 21, the metal belt 22 cannot make a sliding movement in the axial direction of the elastic roller 21. As a result, a possibility that the metal belt 22 nipped and carried between the heat roller 20 and the press roller 30 will make a sliding movement due to a zigzag movement in a standby mode of the image forming apparatus 1 or at the time fixing of the image forming apparatus 1 disappears.

Then, when a main switch is turned off, the foam silicon rubber layer 20*b* of the elastic roller 21 is cooled to contract. When the foam silicon rubber layer 20*b* starts to contract, the space 23 is generated again between the elastic roller 21 and the metal belt 22.

In the case when a usable time of the metal belt 22 is ended while fixing is being performed in this manner, the used metal belt 22 is removed from the elastic roller 21 and the new metal belt 22 is attached on the elastic roller 21 in use, such that the metal belt 22 is replaced. Thus, a satisfactory fixing performance is maintained. In this manner, since the metal belt 22 can be easily attached on the elastic roller 21 or easily detached from the elastic roller 21, the elastic roller 21 can be easily reused. Replacement of the metal belt 22 is not limited to periodical replacement but may be occasionally performed if a trouble occurs. For example, a trouble of the metal belt 22 may be detected through a mark or the like formed on the metal belt 22 by using a sensor and may be detected in an arbitrary way.

In the fixing apparatus 11 according to the first embodiment, the heat roller 20 is configured to include the elastic roller 21 and the metal belt 22 that can slide on the outer periphery of the elastic roller 21. Thus, since the metal roller 22 is not fixed to the elastic roller 21, the metal belt 22 can be easily replaced and the elastic roller 21 can be reused. Furthermore, in the fixing apparatus 11 according to the first embodiment, the flange 58 for regulating the sliding of the metal belt 22 is provided on both sides of the press roller 30. Accordingly, since the metal belt 22 does not run off a fixing area of a sheet, a defective quality of fixing image can be prevented. Moreover, it is prevented that the metal belt is damaged.

In the fixing apparatus 11 according to the first embodiment, the inside surface of the flange 58 is formed smooth. Therefore, in the case when the edge of the metal belt 22 is in contact with the flange 58, the load to the edge of the metal belt 22 applied due to the flange 58 can be reduced and damage of the metal belt 22 can be avoided, and as a result, it is possible to make a life of the metal belt 22 long. In addition, the width of the elastic roller 21 is shorter than the width of the metal belt 22. Accordingly, a side portion of the elastic roller 21 is not exposed from the edge of the metal belt 22 regardless of sliding movement of the metal belt 22. As a result, since the foam silicon rubber layer 20*b* is not damaged by the edge of the metal belt 22, the life of the elastic roller 21 can be made long. In addition, it is possible to prevent that an inside of the printer unit 2 is contaminated due to abrasion of the foam silicon rubber layer 20*b*.

In addition, it is possible to make an apparatus small by providing the flange 58 on the press roller 30 not on the heat roller 20 having limitation in a space.

Next, a second embodiment of the invention will be described. The second embodiment is the same as the first embodiment except for a flange that is a regulating member in the first embodiment described above. Therefore, in the second embodiment, the same configurations as explained in the first embodiment are denoted by the same reference numerals, and detailed explanations thereof will be omitted.

Figure 7:
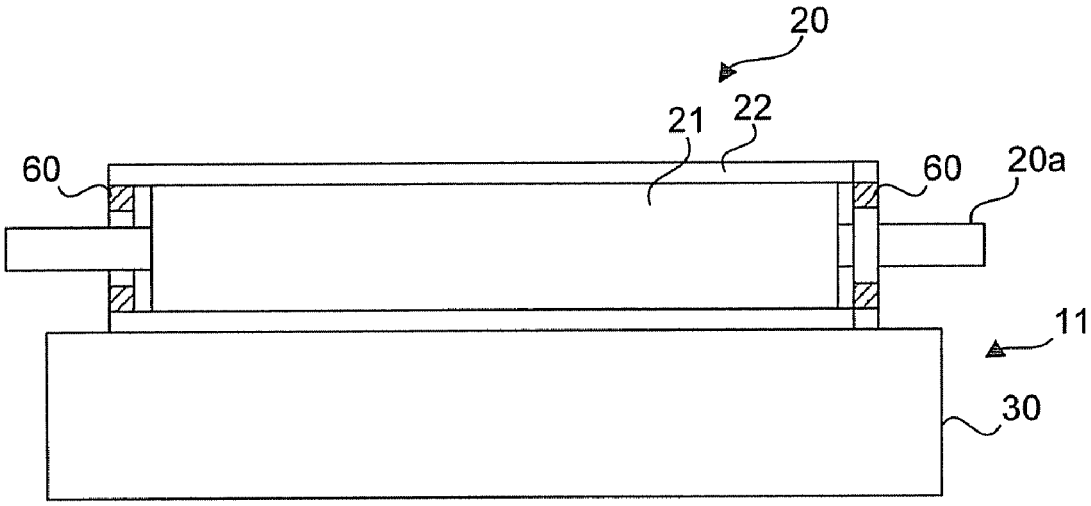
FIG. 7 is a view schematically explaining a heat roller and a press roller in a second embodiment of the invention, as viewed from a direction parallel to an axis.

In the second embodiment, a fixing apparatus 11 includes a regulation ring 60, which is a regulating member, in order to regulate a sliding movement of the metal belt 22 with respect to the elastic roller 21 of the heat roller 20, as shown in FIG. 7. The regulation ring 60 is formed of a rubber material containing heat-resistant silicon rubber, is disposed on both ends of the inner periphery of the metal belt 22, and is attached on the metal belt 22. The regulation ring 60 is not limited to the rubber material, but a heat-resistant resin material may be used.

Figure 8:
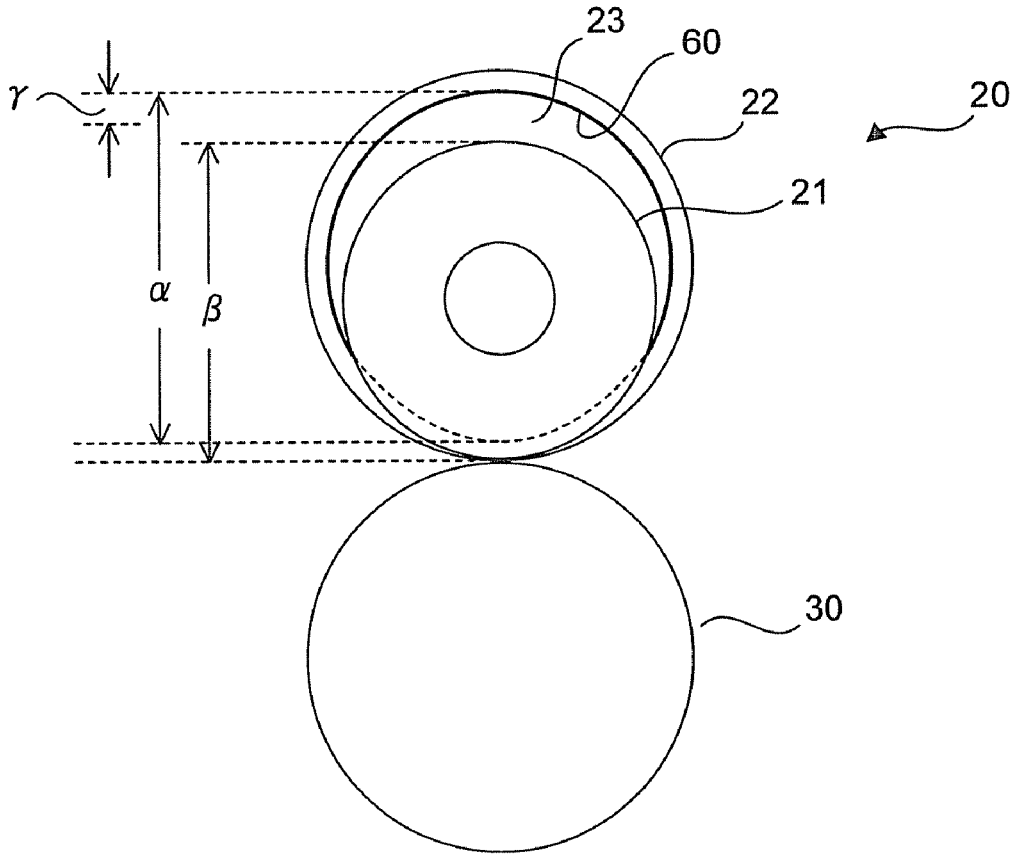
FIG. 8 is an explanatory view schematically illustrating an elastic roller, a metal belt, and a press roller at the room temperature in the second embodiment of the invention.

As shown in FIG. 8, the inner diameter $\alpha$ of the regulation ring 60 is set to be slightly larger than the outer diameter $\beta$ of the elastic roller 21 when the foam silicon rubber layer 20*b* is maintained at the room temperature (25° C.). That is, a gap $\gamma$ is provided between the inner diameter $\alpha$ of the regulation ring 60 and the outer diameter $\beta$ of the elastic roller 21. Accordingly, the metal belt 22 can be replaced without being obstructed by the regulation ring 60. In addition, the inner diameter of the regulation ring 60 is not limited. The regulation ring 60 may be used as long as there is no possibility that an interference with the elastic roller 21 when replacing the metal belt 22 of the regulation ring 60 will occur and the regulation ring 60 has a strength enough to regulate the sliding movement of the metal belt 22 by being in contact with a side surface of the elastic roller 21.

Figure 9:
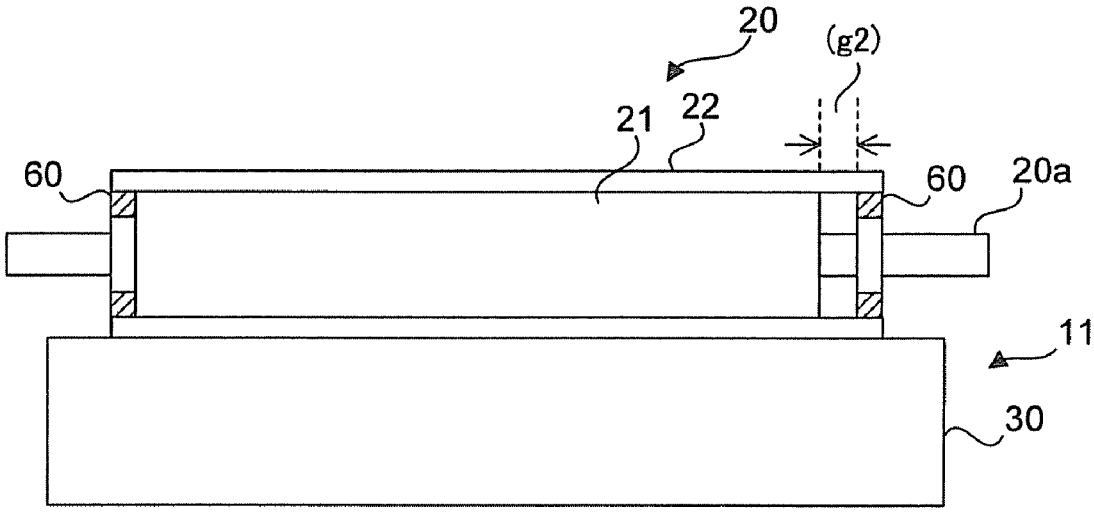
FIG. 9 is an explanatory view schematically illustrating a width between a regulation ring and an elastic roller in the second embodiment of the invention.

Moreover, as shown in FIG. 9, a gap g2 is provided between inside surfaces of the regulation rings 60, which are positioned at both ends of the metal belt 22, and the elastic roller 21. The gap g2 is set to be 0.5 mm or more at the other free end of the metal belt 22 when a side surface of the elastic roller 21 is in contact with the regulation ring 60 at one end of the metal belt 22.

Next, an operation will be described. By start of warming up, warming-up power is supplied to the induction current generating coil 50 and driving of the fixing motor 36 is started. Then, the metal belt 22 is nipped between the heat roller 20 and the press roller 30 to be carried in the direction of arrow s. At the start of warming up, the image forming apparatus 1 is set to almost the room temperature (25° C.). Accordingly, the space 23 is provided between the metal belt 22 and the elastic rollers 21. Moreover, at this time, a gap $\gamma$ is provided between the inner diameter α of the regulation ring 60 and the outer diameter β of the elastic roller 21.

When the metal belt 22 is carried in this state, the regulation ring 60 of the metal belt 22 becomes in contact with a side surface of the elastic roller 21 if the sliding movement of the metal belt 22 increases. Accordingly, a further sliding movement of the metal belt 22 is regulated. Thus, it is possible to prevent that the metal belt 22 is largely run off the elastic roller 21 and is shifted from a fixing area.

At the start of warming up, the gap γ is provided between the inner diameter α of the regulation ring 60 and the outer diameter β of the elastic roller 21, as shown in FIG. 8. For this reason, the entire surface of the regulation ring 60 is not in contact with the elastic roller 21. However, in a region of the nip 37 between the heat roller 20 and the press roller 30 that nip there between and carry the metal belt 22, the regulation ring 60 of the metal belt 22 is in contact with a side surface of the elastic roller 21. By regulation at this position, a further sliding movement of the metal belt 22 is regulated.

On the other hand, the foam silicon rubber layer 20*b* is thermally expanded by heating of the foam silicon rubber layer 20*b* due to the warming up. When thermal expansion of the foam silicon rubber layer 20*b* progresses to increase the outer diameter β of the elastic roller 21, the metal belt 22 fastens the elastic roller 21, such that the metal belt 22 fits onto the elastic roller 21.

Even if the surface temperature of the heat roller 20 reaches the fixable temperature and the warming up is completed, the foam silicon rubber layer 20*b* does not expand rapidly, but the space 23 still remains between the elastic roller 21 and the metal belt 22 for a while from the start of heating. That is, the metal belt 22 does not fit onto the elastic roller 21. For this reason, while the metal belt 22 is being carried in a state in which the metal belt 22 is nipped between the heat roller 20 and the press roller 30, there is a case in which the metal belt 22 makes a sliding movement in the axial direction of the heat roller 20. However, even if the metal belt 22 makes a sliding movement, a further sliding movement of the metal belt 22 is prevented when the regulation ring 60 is in contact with the elastic roller 21, in the same manner as the case of warming up. Accordingly, since it is possible to prevent that the metal belt 22 is largely run off the elastic roller 21 and is shifted from a fixing area at the time of carrying after warming up is completed, it is possible to make the life of the elastic roller 21 and the metal belt 22 long.

If a printing instruction is made after warming up is completed, the printer unit 2 starts a printing operation such that the image forming unit 10 forms a toner image on the sheet paper P. Subsequently, the sheet paper P having the toner image thereon is made to pass through the nip 37 between the heat roller 20 and the press roller 30, such that the toner image is fixed by heating and pressing.

In the meantime, if the heat roller 20 reaches the fixable temperature and the foam silicon rubber layer 20*b* is heated, the foam silicon rubber layer 20*b* of the elastic roller 21 is expanded up to a thickness of about 11 mm, for example. That is, the outer diameter β of the elastic roller 21 becomes larger than the inner diameter of the metal belt 22 by about 0.2 to 0.5 mm. Accordingly, the metal belt 22 fits onto the elastic roller 21 in a state in which the metal belt 22 fastens the elastic roller 21. While reaching this state, the space 23 between the elastic roller 21 and the metal belt 22 is gradually decreased but the metal belt 22 can make a sliding movement in the axial direction of the heat roller 20. Even in this case, a further sliding movement of the metal belt 22, which makes a sliding movement in the axial direction of the heat roller 20, is prevented since the regulation ring 60 is in contact with the elastic roller 21.

After the metal belt 22 has firmly fit onto the elastic roller 21, there is no possibility that the sliding movement will occur due to a zigzag movement of the metal belt 22. Then, when a main switch is turned off, the foam silicon rubber layer 20*b* is cooled to contract. When the foam silicon rubber layer 20*b* starts to contract, the space 23 is generated again between the elastic roller 21 and the metal belt 22.

While fixing is being performed in this manner, the metal belt 22 is replaced if needed by removing the metal belt 22 from the elastic roller 21 and attaching the new metal belt 22 on the elastic roller 21 in use. Replacement of the metal belt 22 is performed when the outer diameter β of the elastic roller 21 is smaller than the inner diameter α of the regulation ring 60 by keeping the foam silicon rubber layer 20*b* at the room temperature (25° C.). Accordingly, the metal belt 22 can be easily replaced without being obstructed by the regulation ring 60. At the time of replacing the metal belt 22 in order to keep a satisfactory fixing performance, the metal belt 22 having the regulation ring 60 on the inner periphery thereof can be easily attached on the elastic roller 21 or detached from the elastic roller 21. Therefore, the elastic roller 21 can be easily reused.

In the fixing apparatus 11 according to the second embodiment, the metal belt 22 can be easily replaced and the elastic roller 21 can be reused, in the same manner as in the first embodiment. Furthermore, in the fixing apparatus 11 according to the second embodiment, the regulation ring 60 for regulating the sliding of the metal belt 22 is provided on the inner periphery of the metal belt 22. Accordingly, since the metal belt 22 does not run off a fixing area of a sheet, a defective quality of fixing image can be prevented. In addition, since a space for providing the regulation ring 60 around the heat roller 20 or the press roller 30 is not needed, it is possible to make the fixing apparatus 11 small.

In addition, the invention is not limited to the embodiments described above, but various modifications can be made within the scope of the invention. For example, a material or a structure of an elastic layer is arbitrary, the cell diameter of open cell foam is not limited, and closed cell foam may be used. Furthermore, the hardness or Young's modulus of the elastic layer is arbitrary. Preferably, the hardness or Young's modulus of the elastic layer is in a range allowing a better fixing performance to be obtained regardless of the fixing speed. In addition, the structures or sizes of the metal belt and the elastic roller are not limited. It is preferable that the metal belt can slide on the elastic roller at the room temperature and the metal roller fit in the elastic roller in a state in which the metal roller fastens the elastic roller when the elastic roller is thermally expanded. In addition, the opposite member may have a belt shape.

What is claimed is:

1. A fixing apparatus comprising:

a metal belt having a metal layer;

an elastic roller which is disposed on an inner side of the metal belt to slidably support the metal belt, whose width is shorter than that of the metal belt, and which has an elastic layer on a surface thereof;

an opposite member that is opposite to the elastic roller with the metal belt interposed there between and nips the metal belt together with the elastic roller and a width of the opposite member is longer than that of the metal belt;

a regulating member that is disposed on both ends of the opposite member and regulates a width-direction sliding range of the metal belt with respect to the elastic roller; and an induction current generator that performs induction heating on the metal layer.

2. The fixing apparatus according to claim 1, wherein the regulating member has a smooth surface.

3. The fixing apparatus according to claim 1, wherein an inner diameter of the regulating member is larger than an outer diameter of the elastic roller when the temperature of the elastic layer is 25° C.

4. A fixing apparatus comprising:

a metal belt having a metal layer;

an elastic roller which is disposed on an inner side of the metal belt to slidably support the metal belt, whose width is shorter than that of the metal belt, and which has an elastic layer which is thermally expanded on a surface thereof and an outer diameter of the elastic roller is smaller than an inner diameter of the metal belt when a temperature of the elastic layer is 25° C. and increases as the temperature of the elastic layer increases;

an opposite member that is opposite to the elastic roller with the metal belt interposed there between and nips the metal belt together with the elastic roller; and an induction current generator that performs induction heating on the metal layer.

5. The fixing apparatus according to claim 4, wherein a width of the opposite member is made longer than that of the metal belt and a regulating member for regulating a width-direction sliding range of the metal belt with respect to the elastic roller is disposed on both sides of the opposite member.

6. The fixing apparatus according to claim 5, wherein the regulating member has a smooth surface.

7. The fixing apparatus according to claim 4, wherein a width of the opposite member is made longer than that of the metal belt and a regulating member for regulating a width-direction sliding range of the metal belt with respect to the elastic roller is disposed on both ends of an inner periphery of the metal belt.

8. The fixing apparatus according to claim 7, wherein a gap is provided between the elastic roller and the regulating member.

9. The fixing apparatus according to claim 8, wherein an the inner diameter of the regulating member is larger than the outer diameter of the elastic roller when the temperature of the elastic layer is 25° C.

10. The fixing apparatus according to claim 4, wherein the metal belt has a rubber layer on an outer side of the metal layer and has a release layer on an outer side of the rubber layer.

11. A control method of a fixing apparatus comprising:

slidably supporting a metal belt, which has a metal layer heated by induction heating, by the use of an elastic roller whose width is shorter than that of the metal belt and which has an elastic layer on a surface thereof;

inductively heating the metal layer and rotating the metal belt in a state in which the metal belt is nipped between the elastic roller and an opposite member; and regulating a sliding movement of the metal belt by causing an end of the metal belt making the sliding movement in a width direction to be in contact with a regulating member disposed at both sides of the opposite member while the metal belt is being rotated.

12. The control method of a fixing apparatus according to claim 11, further comprising:

stopping induction heating of the metal layer;

detaching the metal belt from the elastic roller when the elastic roller is contracted such that an outer diameter of the elastic roller becomes smaller than an inner diameter of the metal belt; and attaching a new metal belt onto the elastic roller.

13. The control method of a fixing apparatus according to claim 11, wherein the elastic layer is thermally expanded, such that an outer diameter of the elastic roller is smaller than an inner diameter of the metal belt when a temperature of the elastic layer is 25° C. and increases as the temperature of the elastic layer increases.

* * * * *